United States Patent [19]

Neumann et al.

[11] Patent Number: 5,047,902

[45] Date of Patent: Sep. 10, 1991

[54] HEADLAMP FOR POWER VEHICLE

[75] Inventors: Rainer Neumann, Stuttgart; Gerhard Lindae, Leonberg-Eltingen, both of Fed. Rep. of Germany

[73] Assignee: Robert Bosch GmbH, Stuttgart, Fed. Rep. of Germany

[21] Appl. No.: 572,619

[22] Filed: Aug. 23, 1990

[30] Foreign Application Priority Data

Oct. 7, 1989 [DE] Fed. Rep. of Germany ..... 3933540

[51] Int. Cl.[5] ..... F21M 3/22

[52] U.S. Cl. ..... 362/61; 362/285; 362/297

[58] Field of Search ..... 362/61, 263, 285, 286, 362/287, 297, 346, 66

[56] References Cited

U.S. PATENT DOCUMENTS 2,132,302 10/1938 Kennelly ..... 362/206
4,612,608 9/1986 Peitz ..... 362/346 X
4,729,077 3/1988 Gordin et al. ..... 362/285
4,811,174 3/1909 Kanzler et al. ..... 362/297 X

FOREIGN PATENT DOCUMENTS 735749 9/1932 France ..... 362/285
316273 11/1956 Switzerland ..... 362/285

*Primary Examiner*—Ira S. Lazarus
*Assistant Examiner*—Richard R. Cole
*Attorney, Agent, or Firm*—Michael J. Striker

[57] ABSTRACT

A headlamp for power vehicles comprises a reflector, a light source arranged in the reflector, the light source and the reflector being movable relative to one another so that in one position the light source is located close to a focal point of the reflector and in another position it is spaced from the focal point both along an optical axis and also vertically relative to the optical axis of the reflector.

11 Claims, 2 Drawing Sheets

HEADLAMP FOR POWER VEHICLE

BACKGROUND OF THE INVENTION

The present invention relates to a headlamp for a power vehicle, and more particularly to such a headlamp which has a reflector and a light source movable relative to one another.

Headlamps of the above mentioned general type are known in the art. One of such headlamps is disclosed for example in the German document DE-AS 2,006,231. This headlamp has a reflector and a light source which is inserted in the reflector and movable relative to the latter in horizontal direction. A screen is arranged in front of the light source and in the screening light position of the light source screens the light emitted by the light source to the lower reflector region. In the high beam position of the light source it is turned back from the screen so that the light extends to the lower reflector region. The adjustment of the light source serves in this headlamp only for switching between the low beam and high beam. An adjustment of the light distribution produced by this headlamp at low beam to different weather conditions for favorable illumination of the roadway and thereby for safety of the vehicle driver is not possible here.

SUMMARY OF THE INVENTION

Accordingly, it is an object of the present invention to provide a headlamp which eliminates the disadvantages of the prior art.

In keeping with these objects and with others which will become apparent hereinafter, one feature of the present invention resides, briefly stated, in a headlamp in which the light source and reflector are adjustable relative to one another so that the light source in one position is located near a focal point of the reflector and in another position is spaced from the focal point both along an optical axis and also vertically relative to the optical axis.

When the headlamp is designed in accordance with the present invention it eliminates the disadvantages of the prior art. By the change of the location of the light source relative to the focal point of the reflector, a change of the light distribution is performed. In one position of the light source near the focal point of the reflector a smaller light band width with a higher maximum light intensity is achieved, which is favorable for fog and snowfall conditions. In the other position of the light source a greater light band width with a smaller maximal light intensity is produced which is favorable for vapor or rain conditions. Due to the change of the location of the light source in a vertical direction, the dark-bright limit of the light distribution remains unchanged.

An increase of the light band width is achieved in accordance with the present invention when the reflector is subdivided in a horizontal central plane into an upper part and a lower part formed so that the upper part in a vertical central plane has a smaller focal length than the lower part.

The reflector in accordance with the present invention is easily manufactured when both parts of the reflector are formed as paraboloids, and parabolas of both paraboloids lying in horizontal central plane are identical.

A further increase of the light band width is achieved when in accordance with another feature of the present invention the parabola of the upper part of the reflector lying in the vertical central plane has a smaller focal length and a parabola of the lower part of the reflector lying in the vertical central plane has a greater focal length than that of a parabola lying in the horizontal central plane.

In accordance with another feature of the present invention, the light source is formed as incandescent light with an incandescent coil arranged horizontally and transversely to the optical axis.

Still a further feature of the present invention is that the light source can be formed as a gas discharge lamp with a light arc arranged horizontally and transversely to the optical axis.

Still another feature of the present invention is that the light source is movable relative to the reflector.

Finally, means is provided for moving the light source relative to the reflector, and the means can be formed as electrical, pneumatic or hydraulic adjusting means.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF A PREFERRED EMBODIMENT

Figure 1:
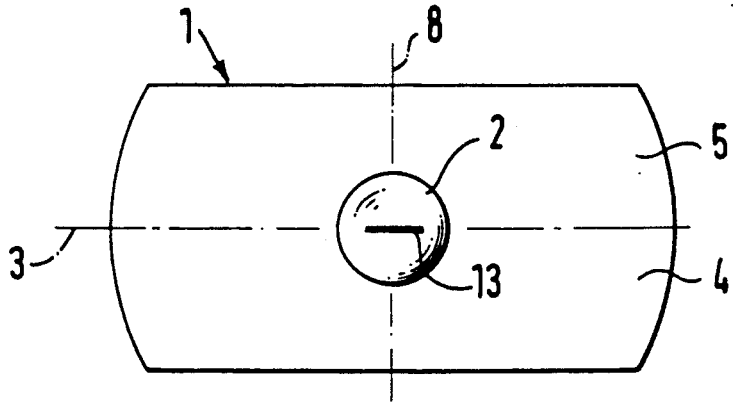
FIG. 1 is a front view of a headlamp in accordance with the present invention.

A headlamp shown in FIG. 1 has a reflector 1 and a light source 2 which is inserted in the reflector 1 from its rear side. The light outlet opening of the reflector 1 is closed by a light disc 15. The reflector 1 is subdivided into two parts 4 and 5 in a horizontal central plane 3. Both reflector parts 4 and 5 are each formed as a paraboloid. The parabolas 7 of the reflector parts 4 and 5 lying in the horizontal central plane are identical. A parabola 9 lying in a vertical central plane 8 of the upper reflector part 5 has a smaller focal distance than the parabola 7 in the horizontal central plane 3. A parabola 11 lying in the vertical central plane 8 of the lower reflector part 4 has a greater focal distance than the parabola 7.

Figure 2:
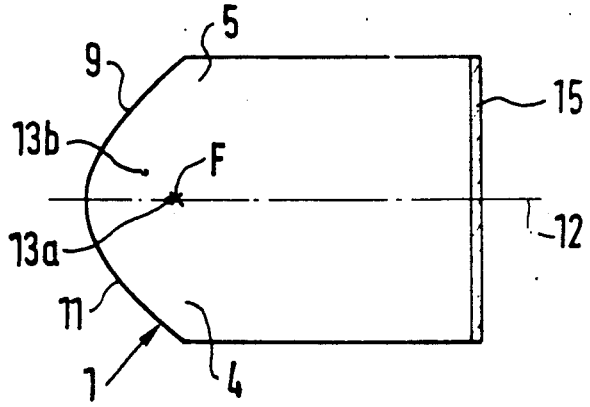
FIG. 2 is vertical central section of the headlamp of FIG. 1.
Figure 3:
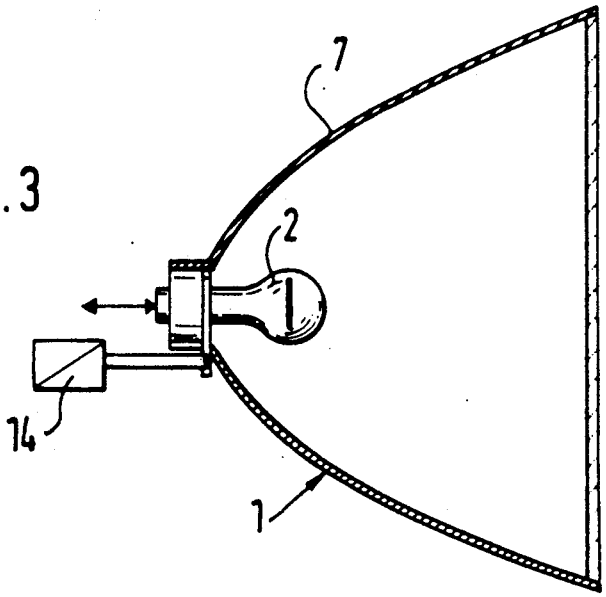
FIG. 3 is a horizontal central section of the headlamp of FIG. 1.

The light source 2 is formed as an incandescent light with a coil 13 arranged horizontally and transverse to the optical axis 12 of the reflector 1. However, it can be formed as a gas discharge lamp with a light arc arranged horizontally to the optical axis 12. The light source 2 is movable relative to the reflector 1 and along the optical axis 12 as well as also vertically to the optical axis 12. FIG. 2 shows only an incandescent coil 3 of the light source 2. A movement of the light source 2 is possible from a position identified with reference 13a in which is located at least close to the focal point F of the reflector 1 on the optical axis 12, to a position identified as 13b in which it is upwardly offset in direction to the apex of the reflector 1 and vertically to the optical axis. The movement of the light source between the positions 13a and 13b can be performed along a straight line or along any arc. It can be activated by an electrical, pneumatic or hydraulic adjusting device 14.

Figure 4:
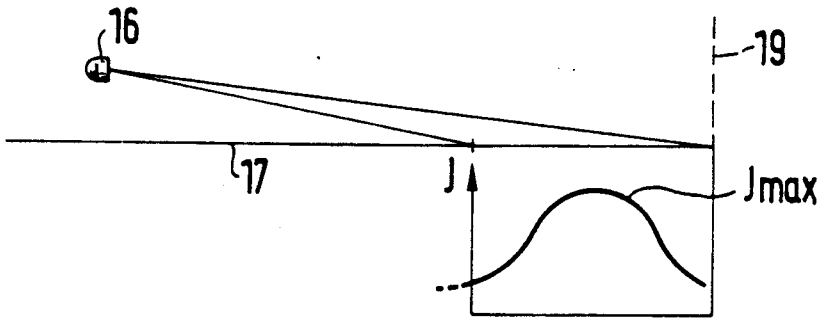
FIG. 4 is a view showing a light distribution produced by the headlamp in accordance with the present invention.
Figure 5:
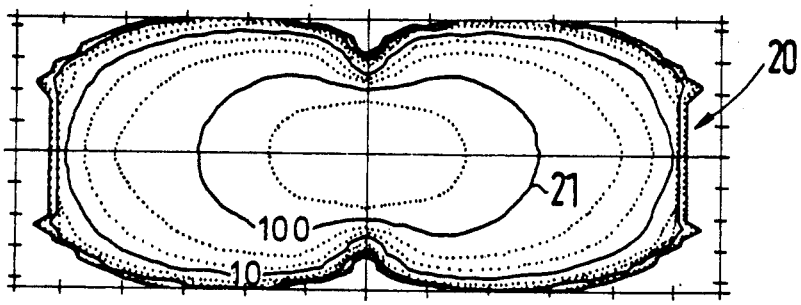
FIG. 5 is a view showing a natural light bundle produced on a measuring screen by the headlamp in accordance with the present invention, with a light source in first position.

When the light source 2 is located in a position 13a, then the light from the light source 2 emitted from the headlamp 13 by reflection on the reflector 1 and the light disc 15, a light distribution over a roadway 17 is obtained with a small light band width shown in FIG. 4, and a high maximum light intensity $I_{max}$. This light distribution is favorable in fog or snowfall conditions, since here the front field of the roadway must be illuminated weaker and as sharp as possible dark-bright limit 12 must be provided to obtain low blinding of the vehicle drivers. The dark-bright limit 12 is produced substantially by the reflector 11 by its subdivision into two parts 4 and 5. The light disc 15 has a horizontal dispersing optical means, by which the light distribution delivered by the reflector is fanned out. FIG. 5 shows a natural light bundle 20 delivered by the headlamp 16 without dispersing disc to a measuring screen, wherein several isolux lines 21 are shown.

Figure 6:
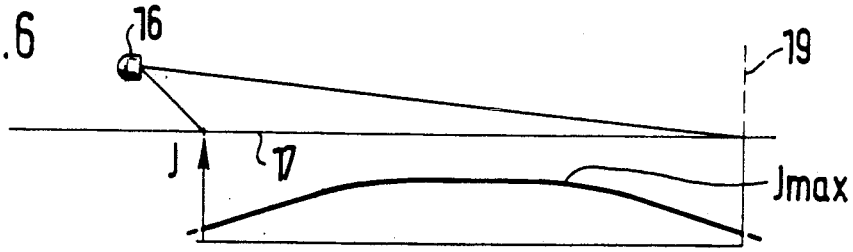
FIG. 6 is a view showing a light distribution.
Figure 7:
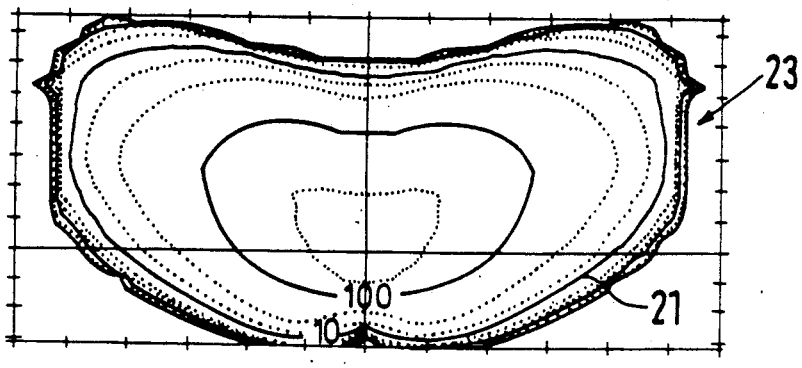
FIG. 7 shows a natural light bundle for a headlamp in accordance with the present invention with a second position of the light source.

When the light source 2 is located in the position 13b, the light distribution from the headlamp 13 shown in FIG. 6 is produced with a greater light band width and a smaller maximum light intensity $I_{max}$. This light distribution is favorable in vapor or rain conditions, since here a high maximal light intensity leads only to a reinforced blinding of the oncoming traffic, and not to an increase of the vision of the vehicle driver. The position of the dark-bright limit 19 is unchanged as compared with FIG. 4 since the light source is spaced vertically upwardly from the optical axis 12. The natural light bundle 23 delivered by the headlamp in this position of the light source to a measuring screen is shown in FIG. 7. As compared with FIG. 5, it has a greater vertical expansion of the natural light bundle 23 relative to the natural light bundle 20 and a greater light band width.

It will be understood that each of the elements described above, or two or more together, may also find a useful application in other types of constructions differing from the types described above.

While the invention has been illustrated and described as embodied in a headlamp for power vehicles, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A headlamp for power vehicles, comprising a reflector; a light source arranged in said reflector, said light source and said reflector being movable relative to one another so that in one position the light source is located close to a focal point of said reflector and in another position it is spaced from said focal point both along an optical axis and also vertically relative to the optical axis of said reflector to produce different light distributions so that in said one position said light source is located on said optical axis of said reflector and in said other position said light source is vertically spaced from said optical axis of said reflector and locations of a dark-bright limit in light distributions in said both positions are substantially the same.

2. A headlamp as defined in claim 1, wherein said reflector is subdivided in a horizontal central plane into an upper part and a lower part, said upper part in a vertical central plane having a smaller focal distance than said lower part.

3. A headlamp as defined in claim 2, wherein both said parts of said reflector are formed as paraboloids such that parabolas of both said paraboloids lying in a horizontal central plane are identical.

4. A headlamp as defined in claim 3, wherein a parabola of said upper part of said reflector lying in a vertical central plane has a smaller focal length and a parabola of said lower part of said reflector lying in the vertical central plane has a greater focal length than a parabola lying in the horizontal central plane.

5. A headlamp as defined in claim 1, wherein said light source is formed as an incandescent lamp with an incandescent coil arranged horizontally and transversely to said optical axis.

6. A headlamp as defined in claim 1, wherein said light source is a gas discharge lamp with a light arc arranged horizontally and transversely to said optical axis.

7. A headlamp as defined in claim 1, wherein said light source is movable relative to said reflector.

8. A headlamp as defined in claim 7; and further comprising an adjusting device arranged to move said light source.

9. A headlamp as defined in claim 8, wherein said adjusting device is an electrical adjusting device.

10. A headlamp as defined in claim 8, wherein said adjusting device is a pneumatic adjusting device.

11. A headlamp as defined in claim 8, wherein said adjusting device is a hydraulic adjusting device.

* * * * *